US006890159B2

(12) United States Patent
Motomura

(10) Patent No.: US 6,890,159 B2
(45) Date of Patent: May 10, 2005

(54) AIR BLOWER WITH FAN UNABLE TO CONTACT MOTOR HOUSING

(75) Inventor: Hirohisa Motomura, Kariya (JP)

(73) Assignee: DENSO Corporation, Kariya (JP)

( * ) Notice: Subject to any disclaimer, the term of this patent is extended or adjusted under 35 U.S.C. 154(b) by 109 days.

(21) Appl. No.: 10/382,814

(22) Filed: Mar. 6, 2003

(65) Prior Publication Data

US 2003/0180165 A1 Sep. 25, 2003

(30) Foreign Application Priority Data

Mar. 19, 2002 (JP) ..... 2002-076073
Apr. 11, 2002 (JP) ..... 2002-109304
May 29, 2002 (JP) ..... 2002-155603

(51) Int. Cl.[7] ..... F04D 29/04

(52) U.S. Cl. ..... 417/423.12; 417/424.2; 416/174; 415/229

(58) Field of Search ..... 415/174.3, 229, 415/230; 416/174; 417/423.12, 424.1, 424.2

(56) References Cited

U.S. PATENT DOCUMENTS 2,851,245 A * 9/1958 Beale ..... 415/174.3
2,882,077 A 4/1959 Marsh
3,494,291 A * 2/1970 Carter, Jr. ..... 417/423.12
4,157,225 A 6/1979 Levine
4,247,246 A * 1/1981 Abe et al. ..... 415/229
4,767,285 A * 8/1988 Jyoraku et al. ..... 417/423.12
4,961,404 A * 10/1990 Itakura et al. ..... 123/41.31
5,569,023 A * 10/1996 Ishida et al. ..... 417/423.12
5,797,727 A 8/1998 Peters et al.
6,382,936 B1 * 5/2002 Schuler et al. ..... 417/423.12

FOREIGN PATENT DOCUMENTS

EP 1130270 9/2001
JP 2001-124101 5/2001

OTHER PUBLICATIONS

French Search Report dated Oct. 15, 2004 in French Application No. 03032521.

* cited by examiner

*Primary Examiner*—Michael Koczo, Jr.
(74) *Attorney, Agent, or Firm*—Harness, Dickey & Pierce, PLC

(57) ABSTRACT

A relative movement of a fan 1 toward a motor 2, which is one of the relative movements of the fan 1 with respect to a rotating shaft 23, is restricted by an inner ring 221 of a radial bearing 22. Due to this, the relative movement of the fan 1 toward the motor 2 is restricted by the inner ring 221 when the joining force between the fan 1 and the rotary shaft 23 is decreased, so that the contact between the fan 1 and the housing 21 can be prevented. Moreover, as the inner ring 221 rotates together with the rotating shaft 23, a rotational force is transferred from the inner ring 221 to the fan 1 in a state in which the relative movement of the fan 1 toward the motor 2 is restricted by the inner ring 221.

18 Claims, 10 Drawing Sheets

AIR BLOWER WITH FAN UNABLE TO CONTACT MOTOR HOUSING

BACKGROUND OF THE INVENTION

1. Field of the Invention

The present invention relates to an air blower in which a motor rotatably drives a fan.

2. Description of the Related Art

Conventionally, the motor rotating shaft of an air blower of this type is composed of a part whose sectional view is D-shaped and a circular bar, and the D-shaped part is inserted into a resin fan. The gap between the D-shaped part and the circular bar prevents the fan from moving toward the motor and, therefore, contact between the fan, which is a rotary body, and a motor housing, which is a non-rotary body, can be avoided.

Moreover, in the above-mentioned conventional air blower, the machining cost of the rotating shaft is high because the D-shaped part is formed in the rotating shaft. Contrary to this, an air blower is widely known, in which the D-shaped part is not used, a rotating shaft whose shape is circular and solid on the whole is used, and a resin fan is press-fitted onto the rotating shaft.

However, in the latter conventional air blower, there is no gap corresponding to the gap in the former conventional air blower, therefore, if the joining force between the fan and the rotating shaft is decreased due to the time degradation and high-temperature creep of the resin fan, etc., it is likely that the fan will move toward the motor and come into contact with the motor housing.

As described above, if the fan comes into contact with the motor housing, a problem occurs that the motor housing, which is a non-rotary body, prevents the fan from rotating and the fan cannot supply air.

SUMMARY OF THE INVENTION

The above-mentioned problem being taken into account, the objective of the present invention is to prevent the fan from coming into contact with the motor housing and to allow a fan to supply air, even if the joining force between the fan and the rotating shaft is decreased.

In order to achieve the above-mentioned objective, the first aspect of the present invention relates to an air blower, comprising a fan (1) that rotates and supplies air and a motor (2) that rotatably drives the fan (1); wherein a rotating shaft (23) of the motor (2) is rotatably supported to a housing (21) by a radial bearing (22), one end of the rotating shaft (23) protrudes to the outside from the housing (21), and the fan (1) is press-fitted onto the one end of the rotating shaft (23); and wherein the relative movement of the fan (1) toward the motor (2), which is one of the relative movements of the fan (1) with respect to the rotating shaft (23), is restricted by an inner ring (221) of the radial bearing (22).

Due to this structure, when the joining force between the fan and the rotating shaft is decreased, the relative movement of the fan toward the motor is restricted by the inner ring and the contact between the fan and the housing can be prevented. Moreover, as the inner ring rotates together with the rotating shaft, the rotational force is transferred from the inner ring to the fan in a state in which the inner ring restricts the relative movement of the fan toward the motor.

As described above, and not only because the contact between the fan and the housing is prevented but also because the rotational force is transferred from the inner ring to the fan, the air blower can continuously supply air even when the joining force between the fan and the rotating shaft is decreased.

In the embodiment of the first aspect of the present invention, for example, a stopper (13), which extends toward the inner ring (221) and is able to come into contact with the inner ring (221), may be provided to the fan (1) as shown in the second aspect of the present invention; a stopper (224), which extends toward the fan (1) and is able to come into contact with the fan (1), may be provided to the inner ring (221) as shown in the third aspect of the present invention; or a stopper or a spacer, one end of which is able to come into contact with the fan (1) and the other end of which is able to come into contact with the inner ring (221), may be arranged between the fan (1) and the inner ring (221) as shown in the fourth aspect of the present invention.

Moreover, the spacer may be made of an iron or a resin as shown in the fifth aspect of the present invention.

In the sixth aspect of the present invention, the stopper (113, 213) is so constructed that it can be easily deformed when a load is imposed thereon in the axial direction of the rotating shaft (23).

In the seventh aspect of the present invention, the spacer is so constructed that it can be easily deformed when a load is imposed in the axial direction of the rotating shaft (23).

Due to this structure, even if a load caused when the fan is press-fitted is imposed on the inner ring because the clearance between the spacer and the inner ring or that between the spacer and the fan is made small, the load acting on the inner ring is mitigated by the deformation of the spacer and abnormal noise from the bearing can be prevented, therefore, it is possible to make unlimitedly small the clearance between the spacer and the inner ring or that between the spacer and the fan, or even to eliminate the clearance, and the dimensional precision in machining parts and the tolerance in assembling parts can be less severe.

In the embodiments of the sixth or the seventh aspects of the present invention, the stopper (113, 213) or the spacer may be formed by using a resin or a rubber as shown in the eighth aspect of the present invention.

In the ninth aspect of the present invention, the structure in which the inner ring restricts the relative movement of the fan in the first aspect comprises a stopper or a spacer provided between the fan and the inner ring.

In the tenth aspect of the present invention, the rotating shaft of the motor is made of metal and formed so that the sectional view of the shaft is circular and solid, and the rotating shaft and the fan rotate integrally because the fan is made of resin and press-fitted onto and fixed to the rotating shaft of the ninth aspect.

In this structure, it is difficult to provide an engaging portion to prevent the movement of the fan to the circular and solid rotating shaft and an unreasonable provision thereof will be a factor that increases the cost of cutting-machining, or the like. Moreover, as the fan is made of resin, it may move in the axial direction of the rotating shaft due to the time degradation but, even in this case, the movement can be prevented without fail by the stopper or the spacer.

In the eleventh aspect of the present invention, the fan is arranged above the motor and the weight of the fan acts downward on the motor in the tenth aspect of the present invention.

Therefore, the weight of the fan always acts so as to move the fan in the axial direction and to move in the direction toward the motor, but the movement can be prevented without fail by the stopper or the spacer.

In the twelfth aspect of the present invention, the fan is a centrifugal multiblade fan of a vehicle air conditioner and is press-fitted onto the rotating shaft, wherein a cap made of a resin harder than that making up the fan is press-fitted onto the rotating shaft on the side of the fan opposite to the motor and protrusions, formed as a part of the cap, engage with the inside of the fan, so that the cap and the fan are prevented from relatively rotating with respect to the shaft, in the eleventh aspect.

In this structure, the fan is prevented from moving toward the side opposite to the motor by the cap securely press-fitted onto the rotating shaft and the movement of the fan toward the motor can be prevented by the stopper or the spacer.

In the thirteenth aspect of the present invention, the centrifugal multiblade fan is a sirocco fan, takes air from the upper side of the fan and discharges air outward in the radial direction of the rotating shaft, in the twelfth aspect.

In this structure, when the fan, which is a sirocco fan, discharges air by the rotation of the fan, it is unlikely that the fan is moved along the rotating shaft in the direction toward the motor by the reaction force of the sirocco fan, therefore, the movement of the fan can be prevented by a small stopper or spacer.

The symbols in the brackets attached to each means show the relationship of correspondence with the concrete means described in the later embodiments.

The present invention may be more fully understood from the description of the preferred embodiments of the invention set forth below, together with the accompanying drawings.

DESCRIPTION OF THE PREFERRED EMBODIMENTS (First Embodiment)

Figure 1:
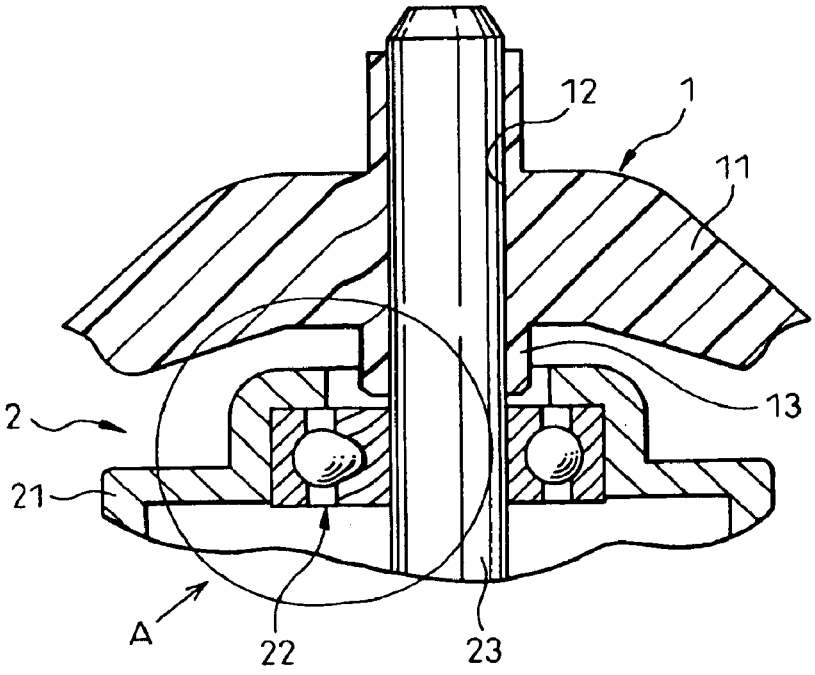
FIG. 1 is a sectional view of major components of an air blower in a first embodiment of the present invention.
Figure 2:
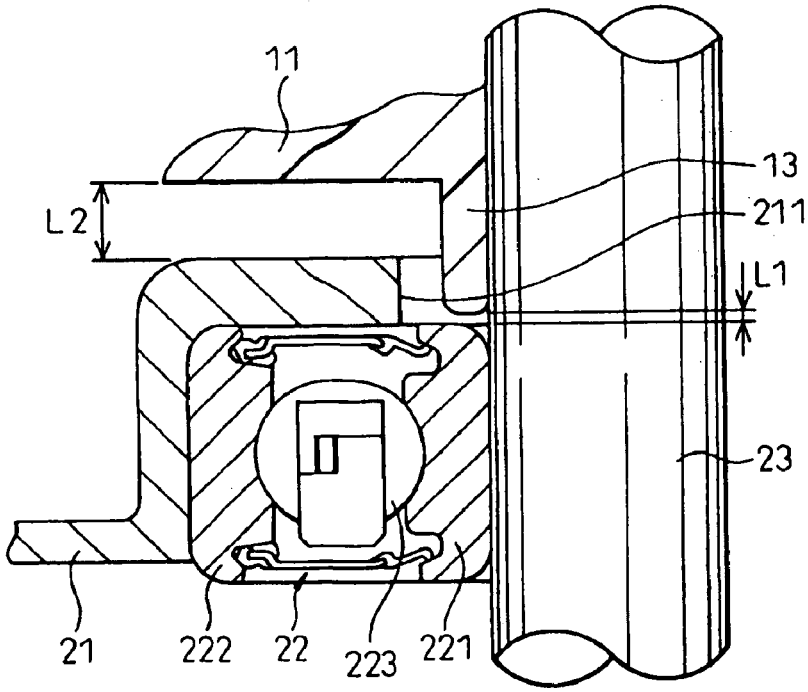
FIG. 2 is an enlarged sectional view of a part A in FIG. 1.

The present invention will be described below based on an embodiment shown in the drawings. FIG. 1 is a sectional view in the vicinity of the coupled portion of a fan and a motor rotating shaft of an air blower in the first embodiment, and FIG. 2 is an enlarged sectional view of a part A in FIG. 1. The air blower in the present embodiment is preferably one to be used, for example, in a vehicle air conditioner.

In FIG. 1 and FIG. 2, an air blower comprises a centrifugal multiblade fan 1 (referred to as a fan 1 hereinafter) that takes in air in the axial direction of a rotating shaft and discharges radially outward and an electric motor 2 (referred to as a motor 2 hereinafter) that rotatably drives the fan 1.

In the motor 2 a bearing 22 is provided at the end of a metallic housing 21 thereof and a metallic rotating shaft 23 is rotatably supported to the housing 21 through the bearing 22.

The bearing 22 is a radial bearing in which balls 223 are arranged between an inner ring 221 and an outer ring 222, the rotating shaft 23 is press-fitted into the inner ring 221, and the outer ring 222 is press-fitted into the housing 21.

In the housing 21, a through-hole 211 whose diameter is larger than that of the inner ring 221 is formed and the inner ring 221 is located within the through-hole 211 when viewed from the axial direction of the rotating shaft 23.

The rotating shaft 23 protrudes to the outside of the housing 21 through the through-hole 211. The horizontally sectional view of the protruded part of the rotating shaft 23 out of the housing 21 is circular and solid and the fan is press-fitted onto the part.

The fan 1 comprises plural blades 11 and receives the rotational force (drive force) of the motor 2 via the rotating shaft 23, because the rotating shaft 23 is press-fitted into an insertion hole 12 formed at the rotation center of the blades 11. At the end of the blade 11 near the motor, a ring-shaped stopper 13 that extends toward the inner ring 221 and is able to come into contact with the inner ring 221 is formed.

The outside diameter of the stopper 13 is substantially equal to the outside diameter of the inner ring 221 and is less than the inside diameter of the through-hole 211, and a part of the stopper 13 is inserted into the through-hole 211 and the end face of the stopper 13 near the motor is opposed to the end face of the inner ring 221 near the fan.

In addition, a clearance L1 between the stopper 13 and the inner ring 221 is made less than a clearance L2 between the blade 11 and the housing 21. The fan 1 is integrally molded out of a thermoplastic resin such as polypropylene.

As the air blower with the above-mentioned structure has the circular and solid rotating shaft 23, it is more likely that the fan 1 moves in the axial direction relative to the rotating shaft 23, when the joining force between the fan 1 and the rotating shaft 23 is decreased due to the time degradation and a high-temperature creep of the resin fan 1, etc.

When the fan 1 moves toward the motor 2, the end face of the stopper 13 near the motor comes into contact with the end face of the inner ring 221 near the fan. Therefore, the fan 1 is restricted from moving further by the inner ring 221.

As L1<L2, even in a state in which the stopper 13 comes into contact with the inner ring 221, the blades 11 do not come into contact with the housing 21. Moreover, as the inner ring 221 rotates together with the rotating shaft 23, in a state in which the stopper 13 comes into contact with the inner ring 221, the rotational force is transferred from the inner ring 221 to the fan 1.

As described above, not only because the contact between the blades 11 and the housing 21 is prevented but also because the rotational force is transferred from the inner ring 221 to the fan 1, the air blower can continuously supply air even when the joining force between the fan 1 and the rotating shaft 23 is decreased.

(Second Embodiment)

Figure 3:
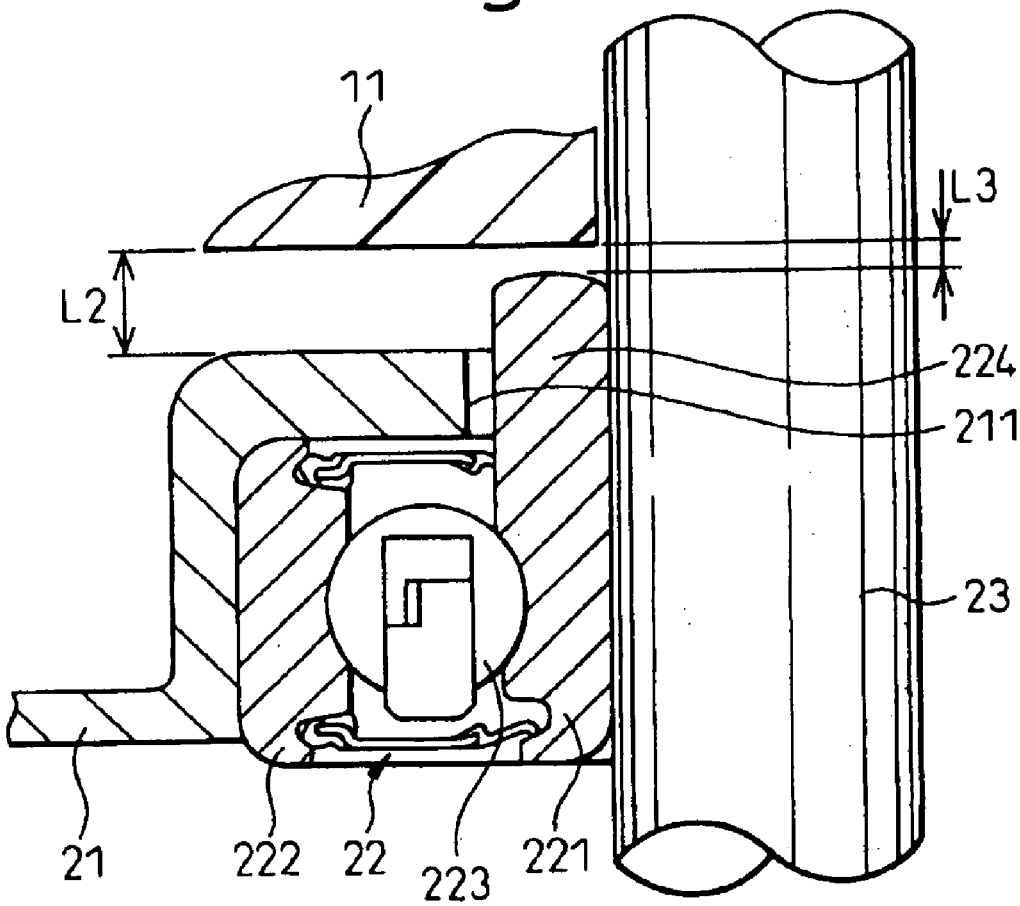
FIG. 3 is a sectional view of major components of an air blower in a second embodiment of the present invention.

In the first embodiment, the stopper 13 extending toward the inner ring 221 is formed integrally with the fan 1, but in the present embodiment, a stopper 224 extending toward the blades 11 and able to come into contact with the blades 11 is formed integrally with the inner ring 221, as shown in FIG. 3.

The stopper 224 penetrates through the through-hole 211 and protrudes to the outside of the housing 21 and the end face of the stopper 224 near the fan is opposed to the end face of the blades 11 near the motor. In addition, the clearance L3 between the stopper 224 and the blades 11 is made less than the clearance L2 between the blades 11 and the housing 21.

In the present embodiment, when the fan 1 moves toward the motor 2, the end face of the blades 11 near the motor comes into contact with the end face of the stopper 224 near the fan. Therefore, the fan 1 is restricted from moving further by the inner ring 221.

As L3<L2, even in a state in which the blades 11 come into contact with the stopper 224, the blades 11 do not come into contact with the housing 21. Moreover, in a state in which the blades 11 come into contact with the stopper 224, a rotational force is transferred from the inner ring 221 to the fan 1. Therefore, the air blower can continuously supply air even when the joining force between the fan 1 and the rotating shaft 23 is decreased.

(Third Embodiment)

Figure 4A:
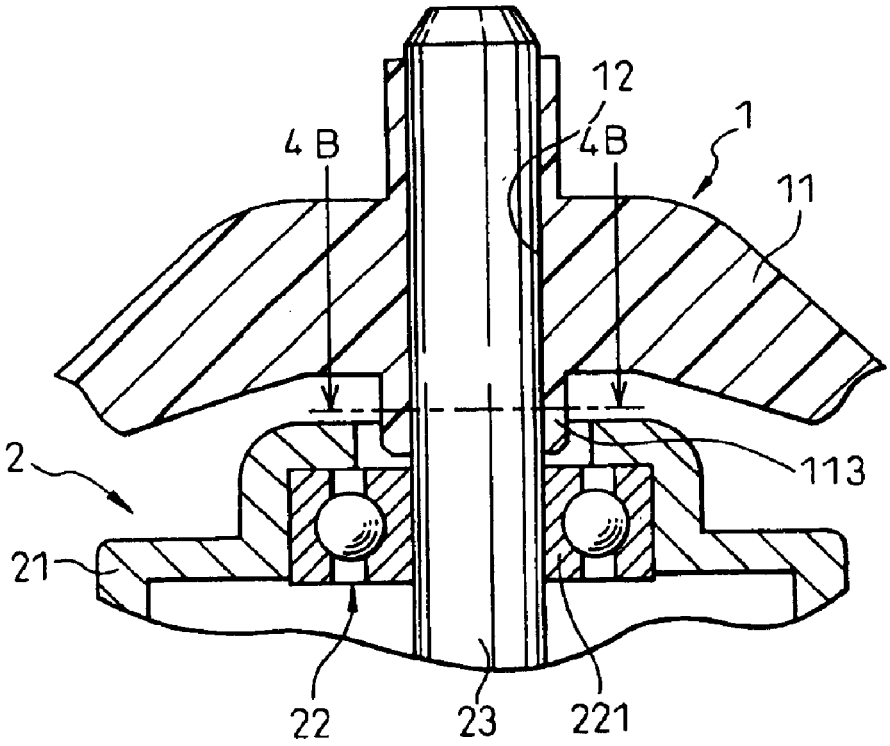
FIG. 4A is a sectional view of an air blower in a third embodiment of the present invention, when a stopper is not deformed.
Figure 4B:
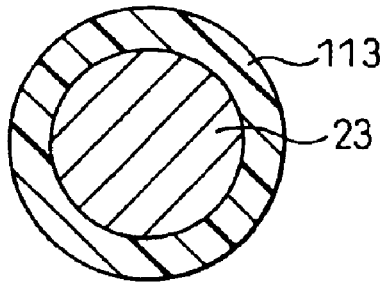
FIG. 4B is a sectional view taken along line 4B—4B in FIG. 4A.
Figure 5:
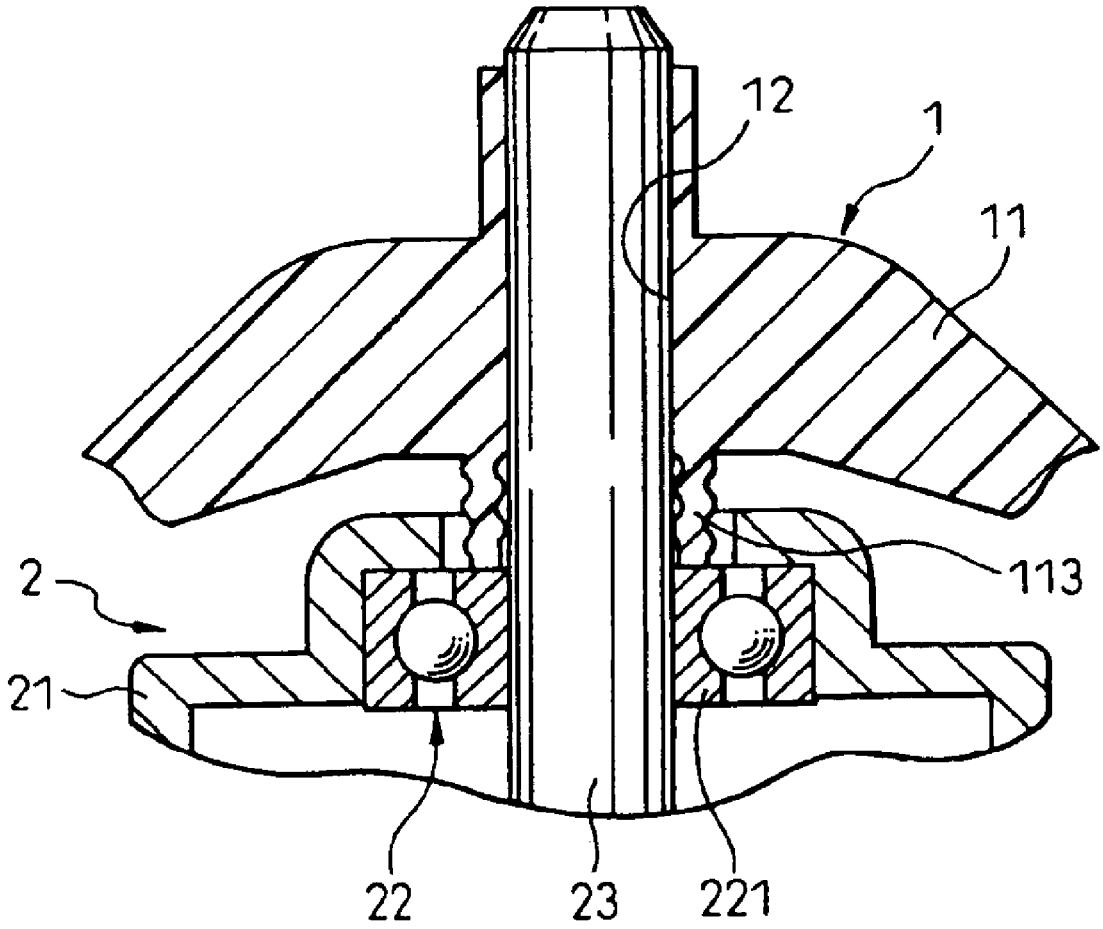
FIG. 5 is a sectional view of the air blower in the third embodiment of the present invention, when the stopper is deformed.

In the present embodiment, a stopper 113 is designed so that it is easily deformed in the axial direction when receiving a load in the axial direction of the rotating shaft 23. FIG. 4A is a sectional view when the stopper 113 is not deformed, FIG. 4B is a sectional view taken along the line 4B—4B in FIG. 4A, and FIG. 5 is a sectional view when the stopper 113 is deformed. The same symbols as those in the first embodiment are used for the same or equivalent parts as those in the first embodiment, and their description is not given here.

In the present embodiment, the fan 1 consists of the blades 11 made of a material and the stopper 113 is made of another material by coinjection molding, in order to enable the stopper 113 to be deformed easily. In concrete terms, the blades 11 are made of polypropylene and the stopper 113 is made of a resin more elastic than polypropylene, for example, an elastomer resin. The stopper 113 has a cylindrical ring shape.

In the first embodiment, if the clearance L1 between the stopper 13 and the inner ring 221 is too large (L2<L1), the blades 11 come into contact with the housing 21 before the stopper 13 does with the inner ring 221. On the other hand, if the clearance L1 between the stopper 13 and the inner ring 221 is too small, when the fan 1 is press-fitted into the rotating shaft 23, the stopper 13 comes into contact with the inner ring 221 and the load caused when press-fitted is imposed directly on the inner ring 221, therefore, there is a possibility that the inner ring 221 will be damaged and the bearing 22 will issue abnormal noise. It is, therefore, required to severely control the precision of the clearance L1 between the stopper 13 and the inner ring 221 and, at the same time, the dimensional precision in machining parts and the tolerance in assembling parts of the fan 1, the motor 2, etc. must be severely controlled.

Contrary to this, according to the present embodiment, even if a load caused when the fan is press-fitted is imposed on the inner ring 221 because the clearance between the stopper 113 and the inner ring 221 is made small, the load imposed on the inner ring 221 is mitigated and the abnormal noise from the bearing 22 can be prevented from occurring because the elastic stopper 113 is easily deformed as shown in FIG. 5. Therefore, the clearance between the stopper 113 and the inner ring 221 can be unlimitedly small, or the clearance can be eliminated, and the dimensional precision in machining parts and the tolerance in assembling parts can be less severe.

(Fourth Embodiment)

Figure 6A:
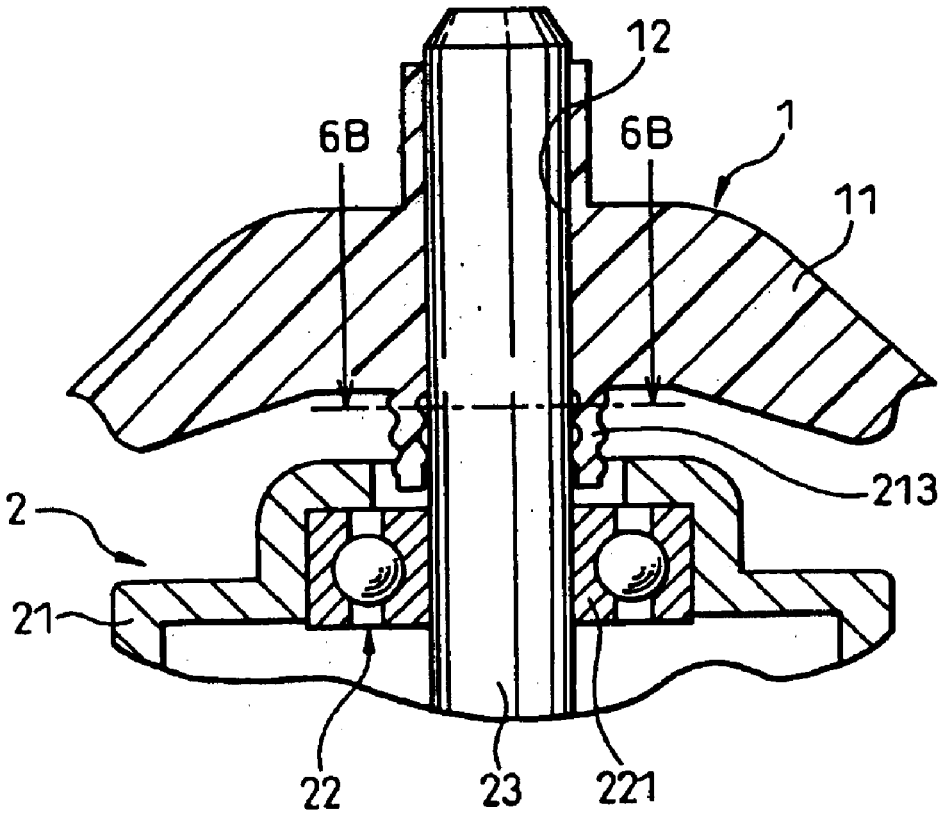
FIG. 6A is a sectional view of major components of an air blower in a fourth embodiment of the present invention.
Figure 6B:
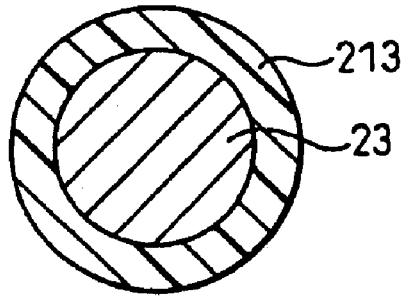
FIG. 6B is a sectional view taken along line 6B—6B in FIG. 6A.

In the present embodiment, a stopper 213 is easily deformed in the axial direction of the rotating shaft 23 when receiving a load in the axial direction thereof, similar to the third embodiment. FIG. 6A is a sectional view of major components of an air blower in the present embodiment and FIG. 6B is a sectional view taken along the line 6B—6B in FIG. 6A. The same symbols as those in the first embodiment are used for the same or equivalent parts, as in the first embodiment, and their description is not given here.

As shown in FIG. 6A, the stopper 213 is designed to be bellows-shaped, in which both the inside and outside diameters thereof are alternately increased and decreased plural times along the axial direction of the rotating shaft 23, in order to enable the stopper 213 to be easily deformed. The blades 11 and the stopper 213 are formed integrally out of a thermoplastic resin such as polypropylene.

According to the present embodiment, even if a load caused when the fan is press-fitted is imposed on the inner ring 221 because the clearance between the stopper 213 and the inner ring 221 is made small, the load imposed on the inner ring 221 is mitigated and abnormal noise from the bearing 22 can be prevented from occurring because the stopper 213 is easily deformed. Therefore, the clearance between the stopper 213 and the inner ring 221 can be unlimitedly small, or the clearance can be eliminated, and the dimensional precision in machining parts and tolerance in assembling parts can be less severe.

(Fifth Embodiment)

Figure 7A:
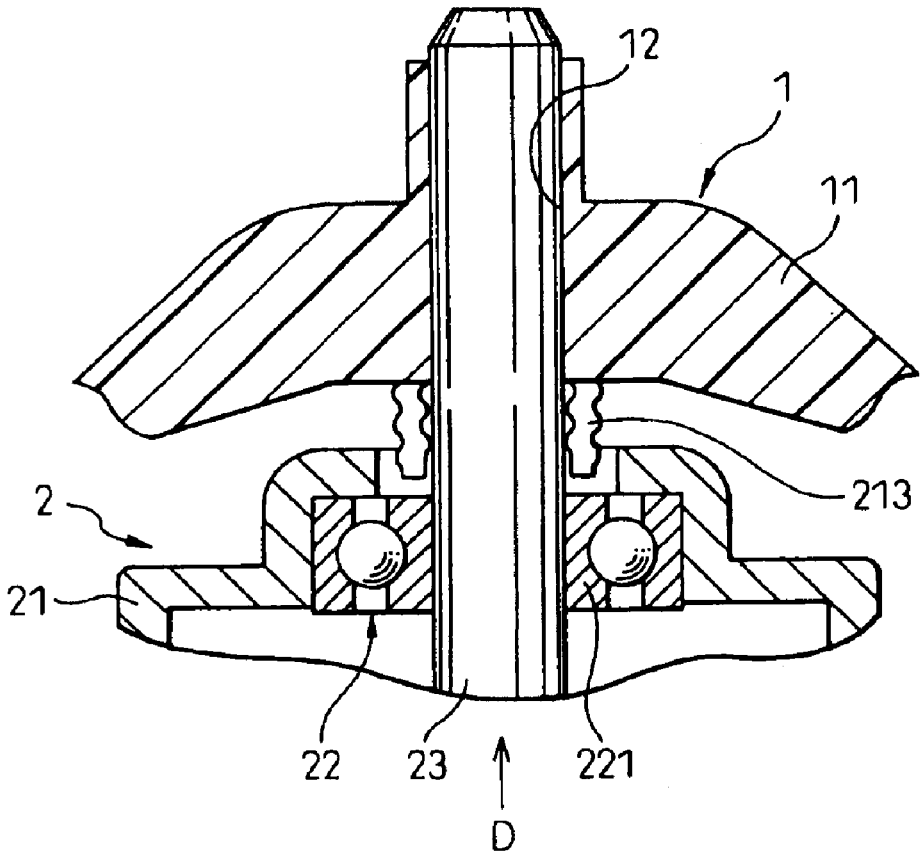
FIG. 7A is a diagram that shows the structure of major components of an air blower in a fifth embodiment of the present invention.
Figure 7B:
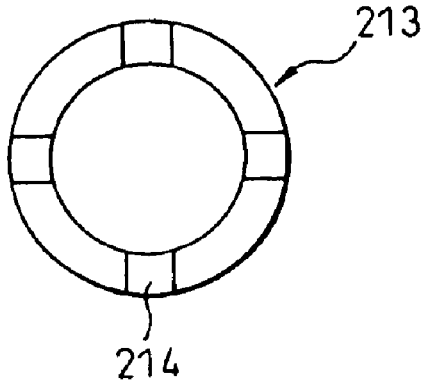
FIG. 7B is a view of a stopper when viewed in the direction of arrow D in FIG. 7A.

In the present embodiment, the stopper 213 in the fourth embodiment is provided with notches 214 50 that the stopper 213 is more easily deformed in the axial direction when receiving a load in the axial direction of the rotating shaft 23. FIG. 7A is a sectional view of major components of an air blower in the present embodiment and FIG. 7B is a view of the stopper 213 viewed in the direction of arrow D in FIG. 7A. The same symbols as those in the fourth embodiment are used for the same or equivalent parts, as the fourth embodiment, and their description is not given here.

As shown in FIG. 7A, the stopper 213 is provided with the four notches 214 that extend in the axial direction of the rotating shaft 23 and are equally spaced in the circumferential direction. Because of the provision of the notches 214, the stopper 213 in the present embodiment can be deformed more easily than that in the fourth embodiment, and the effects in the fourth embodiment can be further magnified in the present embodiment.

(Other Embodiments)

In the first and second embodiments described above, though the stoppers 13 and 224 are formed integrally with the fan 1 or the inner ring 221, the stoppers 13 and 224 need not be used and, at the same time, a stopper or a spacer, which is a separate body distinct from the fan 1 or the inner ring 221, may be arranged between the blades 11 and the inner ring 221.

In concrete terms, the rotating shaft 23 is free-fitted or press-fitted into a ring-shaped spacer made of an iron, a resin, or the like and, at the same time, the spacer is arranged between the blades 11 and the inner ring 221 so that one end of the spacer is opposed to the blades 11 and the other end of the spacer is opposed to the inner ring 221.

When the fan 1 moves toward the motor 2, the spacer comes into contact with the blades 11 and the inner ring 221, therefore, the fan 1 is prevented from moving further by the inner ring 221, the blades 11 are prevented from coming into contact with the housing 21, and a rotational force is transferred from the inner ring 221 to the fan 1 via the spacer.

If the stopper or spacer, which is a separate body from the fan 1 and the inner ring 221, is made of an elastic resin or rubber, the same effects as those in the third to fifth embodiments can also be obtained because the spacer can be easily deformed in the axial direction of the rotating shaft 23 when receiving a load in the axial direction thereof.

Although the stoppers 113 and 213 are formed integrally with the fan 1 in the third to fifth embodiments, the same effects as those in the third to fifth embodiments can also be obtained if a stopper made of an elastic resin or rubber is mounted onto the end face of the inner ring 221 near the fan by means of adhesion or the like and the stopper is enabled to be easily deformed in the axial direction of the rotating shaft 23 when receiving a load in the axial direction thereof.

Figure 8:
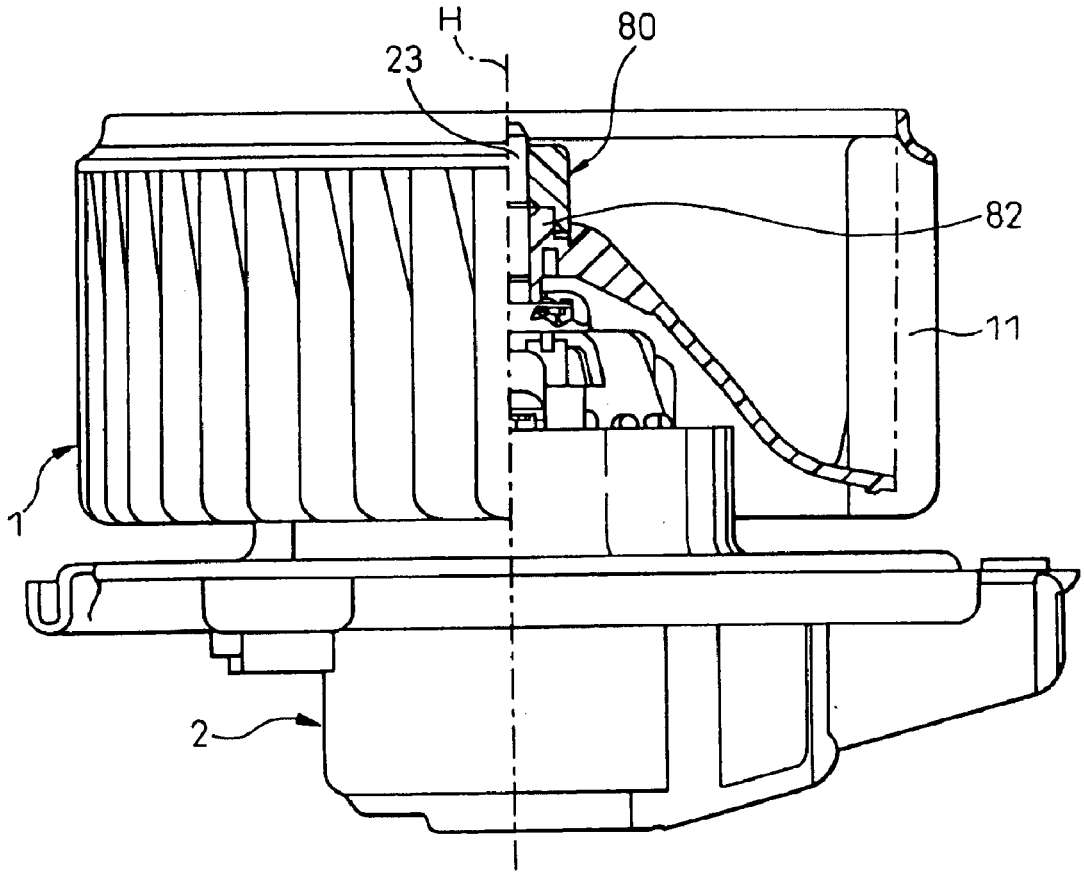
FIG. 8 is a sectional view of an embodiment in which the present invention is applied to a centrifugal air blower of a vehicle air conditioner.
Figure 9:
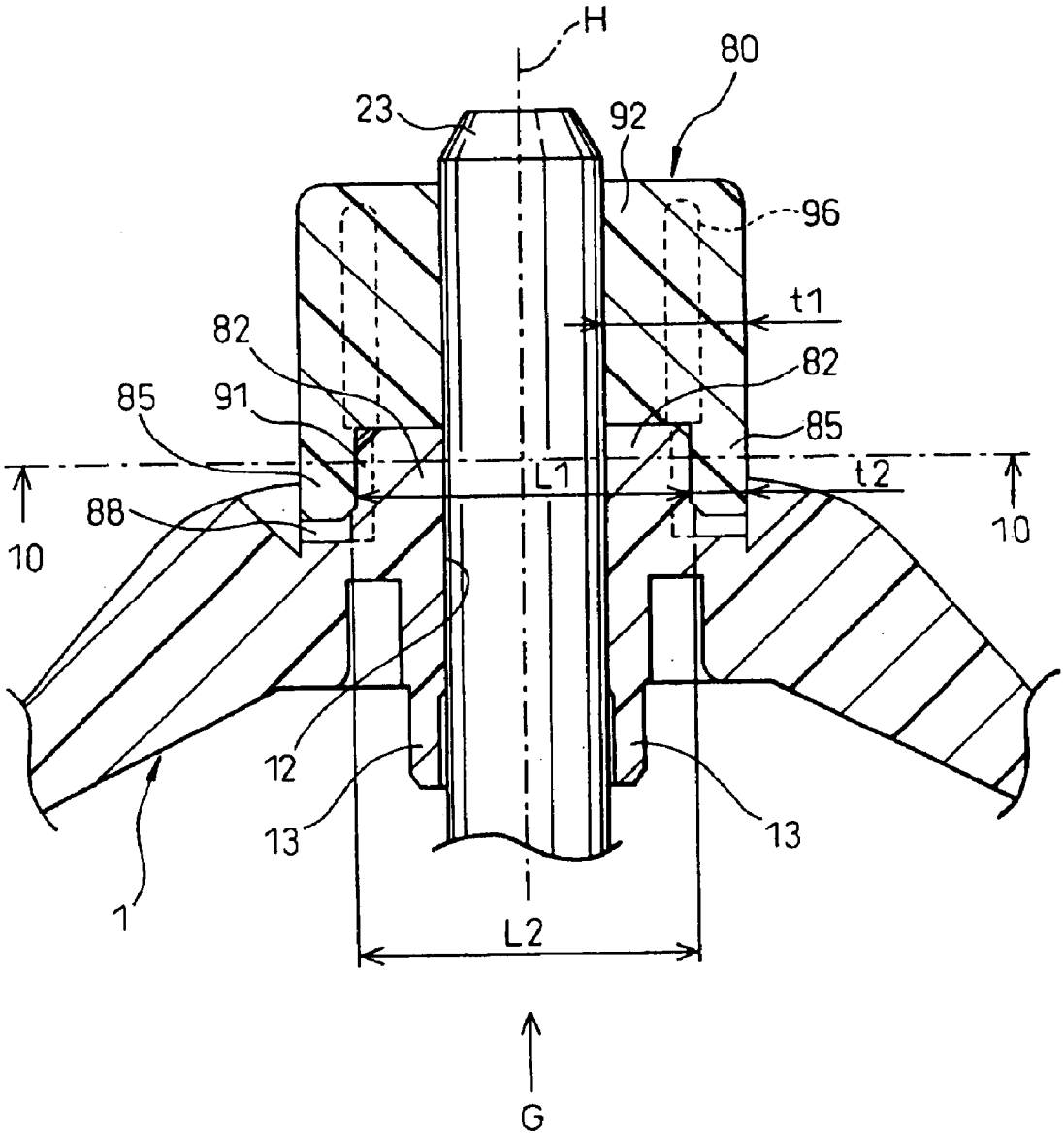
FIG. 9 is an enlarged sectional view of major components of the air blower in FIG. 8.
Figure 10:
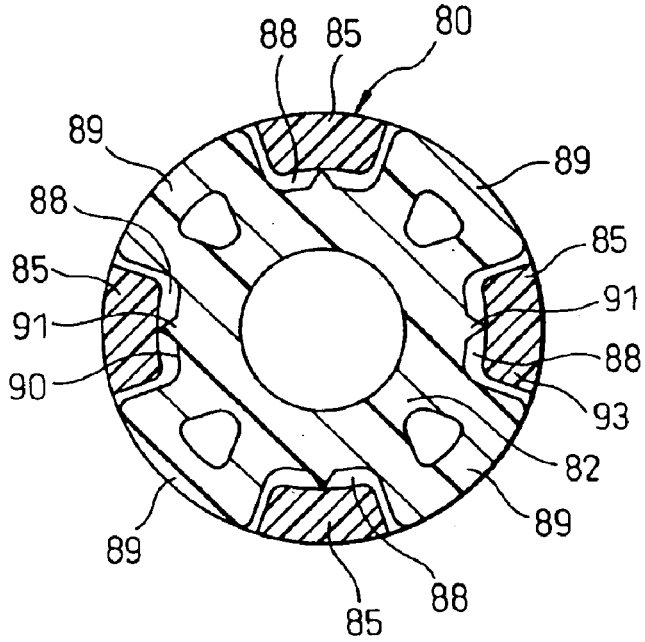
FIG. 10 is a sectional view taken along the line 10—10 in FIG. 9.
Figure 11:
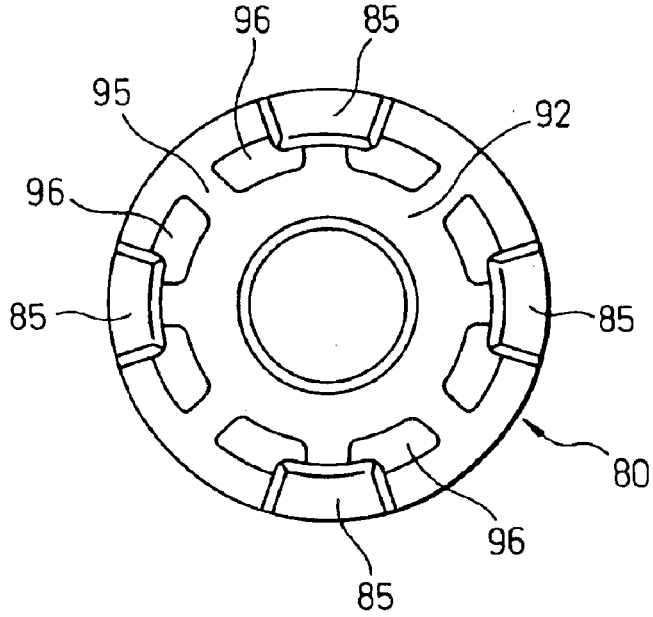
FIG. 11 is a diagram that shows a cap 80 alone, when viewed in the direction of arrow G, in FIG. 9.

Each embodiment described above can be applied to a centrifugal air blower of a vehicle air conditioner as shown in FIG. 8 and the following drawings. FIG. 8 is a sectional view of a centrifugal air blower (referred to as air blower hereinafter) in the present embodiment, FIG. 9 is an enlarged view of the insertion part of a fan 1 and a cap 80 to a shaft 23, FIG. 10 is a sectional view taken along the 10—10 line in FIG. 9, and FIG. 11 is a view of the cap 80 alone, when viewed in the direction of arrow G, in FIG. 9.

In FIG. 8, the air blower comprises a centrifugal multi-blade fan 1, which is a sirocco fan (referred to as a fan 1 hereinafter) and takes in air from the axial direction H of the rotating shaft and discharges radially outward, an electric motor 2 that rotatably drives the fan 1 and a cap 80 that transfers the rotational force of the electric motor 2 to the fan 1.

The electric motor 2, which corresponds to a drive means, comprises a drive shaft 23 (referred to as a shaft 23 hereinafter) and the shaft 23 is made of metal and its sectional view is circular and solid.

The fan 1 comprises a substantially cylindrical fan boss 82 (FIG. 9) into which the shaft 23 is press-fitted and plural blades 11 (FIG. 8) that are connected to the fan boss 82 and rotate together with the shaft 23 integrally. The fan boss 82 and the blades 11 are molded integrally out of a thermoplastic resin such as polypropylene.

As shown in FIG. 9 and FIG. 10, the fan boss 82 is provided with four recesses 88, into which legs 85 (to be described in detail later) of the cap 80 are inserted, and four protrusions 89 located between the recesses 88 on its outer circumference near the cap 80, and these recesses 88 and protrusions 89 are spaced equally and alternately along the circumferential direction.

On the surface of each recess 88, which is near the rotating shaft 23 and faces radially outward, that is, a bottom 90 of each recess 88, a protrusion 91, the top of which comes into close contact with the inner circumferential surface of the leg 85, is formed.

The protrusion 91 extends in the axial direction of the rotating shaft 23 as well as protruding radially outward from the bottom 90 toward the leg 85, and its sectional view perpendicular to the rotating shaft 23 is a triangle, the pointed vertex of which is directed to the leg 85.

The dimension L2 between the points of the two protrusions 91 located so as to sandwich the axial line H of the rotating shaft is larger than the dimension L1 between the two legs 85 that sandwich the axial line H of the rotating shaft and are opposed to each other. The dimension L2 in this case is a dimension formed before the fan 1 and the cap 80 are assembled.

The cap 80 is made of a resin that is harder than that of the fan 1 and, to be exact, for example, is a resin the tensile strength of which is high, such as polyamide resinforced with glass. The cap 80 comprises, as shown in FIG. 9 to FIG. 11, a cylindrical cap boss 92 into which the shaft 23 is press-fitted and the four legs 85 that extend from the outer circumference of the cap boss 92 toward the fan boss 82 and are inserted into the recesses 88. The thickness t1, in the radial direction, of the cap boss 92 is larger than the thickness t2, in the radial direction, of the leg 85.

In the cap boss 92, eight cavities 96 that extend toward the center axis of rotation H and open in the end faces near the fan boss 82 are formed. These cavities 96 are equally spaced in the circumferential direction. Between the cavities 96, connecting portions 95 that connect the more inner parts than the cavities 96 in the cap boss 92 to the more outer parts than the cavities 96 in the cap boss 92 are formed.

In assembling the above-mentioned air blower, the fan 1 and the cap 80 are temporarily fixed first. When the legs 85 are inserted into the recesses 88, each point of the protrusions 91 is deformed plastically because the fan 1 in which the protrusions 91 are formed is softer than the cap 80 in which the legs 85 are formed and the above-mentioned dimension between the opposite two legs 85 is less than that between the opposite protrusions 91. In this way, each point of the protrusions 91 comes into close contact with the legs 85 and the fan 1 and the cap 80 are temporarily fixed.

Then, the shaft 23 is press-fitted into the fan 1 and the cap 80. Therefore, the rotational force from the shaft 23 is transferred directly to the fan 1 as well as being transferred to the fan 1 via the cap 80 because the legs 85 are engaged with the recesses 88. However, as the pressure of contact surfaces, the contact area, or the like are set so that the torque, which will stop the relative rotation between the cap 80 and the shaft 23, is larger than that which will stop the relative rotation between the fan 1 and the shaft 23 after the fan 1 and the cap 80 are press-fitted onto the shaft, the rotational force from the shaft 23 is transferred to the fan 1 mainly via the cap 80.

In the present embodiment, as the cap 80 that transfers the rotational force is made of a resin harder than that of the fan 1, the press-fitting force can be increased by sufficiently increasing the pressure of contact surfaces between the cap 80 and the shaft 23, and as the thickness t1 of the cap boss 92 into which the shaft 23 is press-fitted is larger than the thickness t2 of the legs 85, the press-fitting force can be increased by sufficiently increasing the pressure of contact surfaces between the cap 80 and the shaft 23, as a result a large rotational force can be transferred from the shaft 23 to the fan 1. Therefore, it is possible to obtain a sufficient torque to stop the relative rotation even if the cap 80 is made of a cheap resin and the cost can be reduced because of use of the cheap resin.

Moreover, the provision of the cavities 96 prevents a sinking (plastic deformation) of cap 80 material, which is characteristic of a resin, so that the elasticity of the cap 80 is increased, therefore the press-fitting force of the cap 80 can be increased by sufficiently increasing the pressure on contact surfaces between the cap 80 and the shaft 23 and the torque to stop the relative rotation can be further increased.

Moreover, as each point of the protrusions 91 is deformed so as to come into close contact with the legs 85, the fan 1 and the cap 80 can be fixed temporarily without requiring severe dimensional precision. Therefore, only one process is required as the press-fitting process of the shaft 23 because the shaft 23 is press-fitted in a state in which the fan 1 and the cap 80 are temporarily fixed.

Figure 12A:
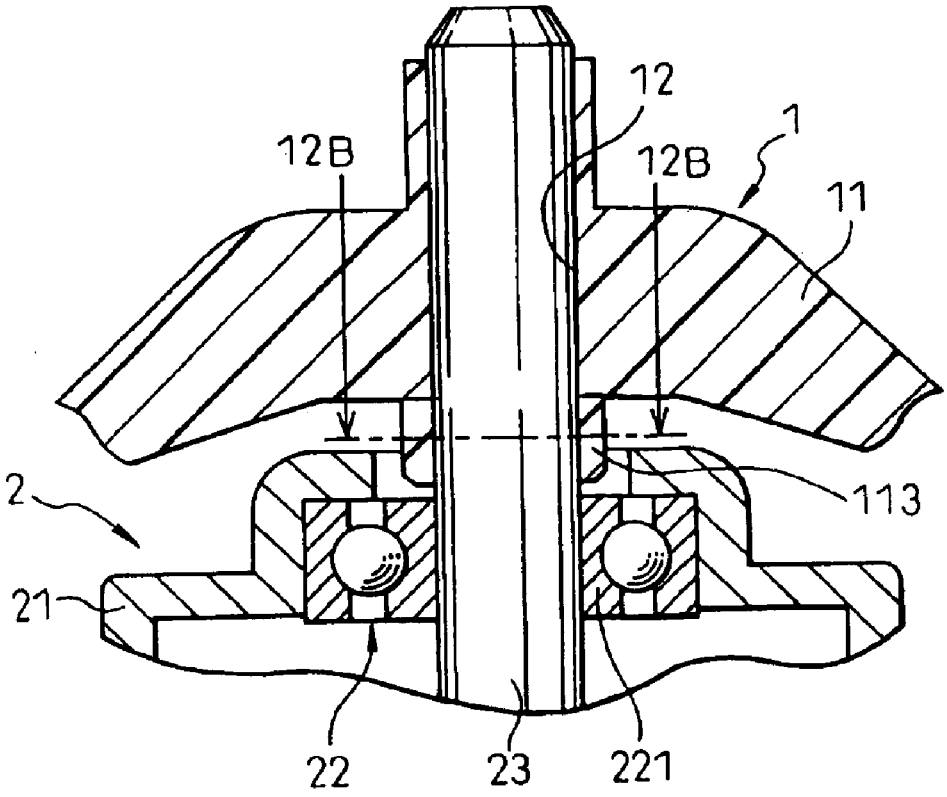
FIG. 12A is a view similar to FIG. 4A but showing the stopper or spacer as a separate component.
Figure 12B:
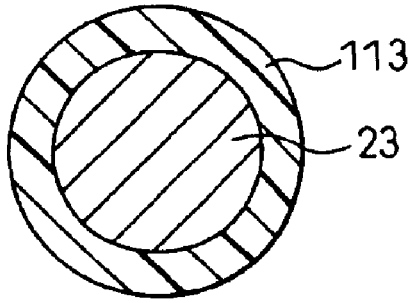
FIG. 12B is a sectional view taken along line 12B—12B in FIG. 12A.

FIGS. 12A and 12B illustrate an embodiment where stopper 113 is a separate component from fan 1 and from inner ring 221.

While the invention has been described by reference to specific embodiments chosen for the purposes of illustration, it should be apparent that numerous modifications could be made thereto by those skilled in the art without departing from the basic concept and scope of the invention.

What is claimed is:

1. An air blower, comprising:

a fan that rotates to supply air, and a motor that rotatably drives the fan; wherein a rotating shaft of the motor is rotatably supported in a housing through a radial bearing having an inner ring and an outer ring, one end of the rotating shaft protrudes to the outside from the housing, the fan is press-fitted onto the one end of the rotating shaft to form an axial clearance between the fan and the inner ring of the radial bearing; and the relative movement of the fan toward the motor, is restricted by contact between the inner ring of the radial bearing and the fan.

2. An air blower, as set forth in claim 1, wherein the fan comprises a stopper that extends toward the inner ring and is able to come into contact with the inner ring.

3. An air blower, as set forth in claim 1, wherein the inner ring comprises a stopper that extends toward the fan and is able to come into contact with the fan.

4. An air blower, as set forth in claim 1, wherein a spacer, whose one end is able to come into contact with the fan and, whose other end is able to come into contact with the inner ring, is arranged between the fan and the inner ring.

5. An air blower, as set forth in claim 4, wherein the spacer is made of iron.

6. An air blower, as set forth in claim 2, wherein the stopper is so structured that it can be easily deformed when receiving a load in an axial direction of the rotating shaft.

7. An air blower, as set forth in claim 4, wherein the spacer is so structured that it can be easily deformed when receiving a load in an axial direction of the rotating shaft.

8. An air blower, as set forth in claim 6, wherein the stopper is made of a resin.

9. An air blower, as set forth in claim 1, further comprising one of a stopper and a spacer provided between the fan and the inner ring.

10. An air blower, as set forth in claim 9, wherein the rotating shaft of the motor is made of metal and its cross section is circular and solid, and wherein the fan is made of resin.

11. An air blower, as set forth in claim 10, wherein the fan is arranged at a position vertically above the motor and the weight of the fan acts downward on the motor.

12. An air blower, as set forth in claim 11;

wherein the fan is a centrifugal multiblade fan of a vehicle air conditioner;

wherein, a cap made of resin harder than that of the fan is press-fitted onto the rotating shaft; and wherein a protrusion formed of a part of the cap is engaged with the inside of the fan to stop the relative rotation between the cap and the fan.

13. An air blower, as set forth in claim 12, wherein the centrifugal multiblade fan is a sirocco fan that takes in air from an axial direction of the fan and discharges radially outward with respect to the rotating shaft.

14. An air blower, as set forth in claim 4, wherein the spacer is made of a resin.

15. An air blower, as set forth in claim 6, wherein the stopper is made from a rubber.

16. An air blower, comprising:

a fan that rotates to supply air and a motor that rotatably drives the fan;

wherein a rotating shaft of the motor is rotatably supported in a housing through a radial bearing having an inner ring and an outer ring, one end of the rotating shaft protrudes to the outside from the housing, and the fan is press-fitted onto the one end of the rotating shaft;

wherein the relative movement of the fan toward the motor, which is one of the relative movements of the fan with respect to the rotating shaft, is restricted by the inner ring of the radial bearing; and the inner ring comprises a stopper that extends toward the fan and is able to come into contact with the fan.

17. An air blower, comprising:

a fan that rotates to supply air and a motor that rotatably drives the fan;

wherein a rotating shaft of the motor is rotatably supported in a housing through a radial bearing having an inner ring and an outer ring, one end of the rotating shaft protrudes to the outside from the housing, and the fan is press-fitted onto the one end of the rotating shaft;

wherein the relative movement of the fan toward the motor, which is one of the relative movements of the fan with respect to the rotating shaft, is restricted by the inner ring of the radial bearing; and the fan comprises a stopper that extends toward the inner ring and is able to come into contact with the inner ring;

the stopper is so structured that it can be easily deformed when receiving a load in the axial direction of the rotating shaft; and the stopper and the spacer are made of either a resin or a rubber.

18. An air blower, comprising:

a fan that rotates to supply air and a motor that rotatably drives the fan;

wherein a rotating shaft of the motor is rotatably supported in a housing through a radial bearing having an inner ring and an outer ring, one end of the rotating shaft protrudes to the outside from the housing, and the fan is press-fitted onto the one end of the rotating shaft;

wherein the relative movement of the fan toward the motor, which is one of the relative movements of the fan with respect to the rotating shaft, is restricted by the inner ring of the radial bearing; and the structure restricted by the inner ring comprises a stopper or a spacer provided between the fan and the inner ring;

the rotating shaft of the motor is made of metal and its section is circular and solid, and the rotating shaft and the fan rotate integrally because the fan is made of resin and is press-fitted onto the rotating shaft;

the fan is arranged above the motor and the weight of the fan acts downward on the motor;

the fan is a centrifugal multiblade fan of a vehicle air conditioner;

on the side of the fan, near the opposite side of the motor, which has been press-fitted onto the rotating shaft, a cap made of resin harder than that of the fan is press-fitted onto the rotating shaft; and a protrusion formed of a part of the cap is engaged with the inside of the fan to stop the relative rotation between the cap and the fan.

* * * * *